US006701119B2

(12) United States Patent
Tomiki et al.

(10) Patent No.: US 6,701,119 B2
(45) Date of Patent: Mar. 2, 2004

(54) IMAGE FORMING APPARATUS INCLUDING OPPOSED INSULATING AND CONDUCTING TRANSFER MATERIAL GUIDE MEMBERS TO PREVENT NULL TRANSFER

(75) Inventors: Satoshi Tomiki, Tokyo (JP); Jiro Kinokuni, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 09/983,721

(22) Filed: Oct. 25, 2001

(65) Prior Publication Data

US 2002/0064405 A1 May 30, 2002

(30) Foreign Application Priority Data

Nov. 1, 2000 (JP) ..... 2000-335130

(51) Int. Cl.[7] ..... G03G 15/16
(52) U.S. Cl. ..... 399/316; 399/388
(58) Field of Search ..... 399/316, 317, 399/388

(56) References Cited

U.S. PATENT DOCUMENTS 5,268,724 A * 12/1993 Koizumi et al. ..... 399/388

5,926,682 A * 7/1999 Tomiki ..... 399/388

* cited by examiner

*Primary Examiner*—William J. Royer
(74) *Attorney, Agent, or Firm*—Fitzpatrick, Cella, Harper & Scinto

(57) ABSTRACT

An image forming apparatus includes an image bearing member for bearing a developer image; an image forming apparatus for forming the developer image borne on the image bearing member; a transferring apparatus for electrostatically transferring the developer image on the image bearing member to a transferring material in a transferring area; and a guiding member for guiding the transferring material into the transferring area. The guiding member includes an insulating member disposed on a transferring material guide surface and a conductive member disposed on a surface opposite to the transferring material guide surface. A power source capable of applying a voltage having a predetermined polarity is electrically connected to the conductive member. A projection is provided on the surface of the insulating member.

24 Claims, 7 Drawing Sheets

IMAGE FORMING APPARATUS INCLUDING OPPOSED INSULATING AND CONDUCTING TRANSFER MATERIAL GUIDE MEMBERS TO PREVENT NULL TRANSFER

BACKGROUND OF THE INVENTION

1. Field of the Invention

The present invention relates to an image forming apparatus such as a copying machine, printer, and facsimile machine in which an image is formed by an electrophotographic system, electrostatic recording system, and the like.

2. Related Background Art

For example, as shown in FIG. 7, an image forming apparatus which utilizes an electrophotographic system, such as a copying machine, printer, and facsimile machine, includes a drum type electrophotographic photosensitive body (hereinafter referred to a photosensitive drum) 1 as an image bearing member, and a primary charging unit 2, developing apparatus 3, transfer charging unit 4, and cleaning apparatus 5 disposed around the photosensitive drum 1. Moreover, an exposing apparatus 6 is disposed above and between the primary charging unit 2 and the developing apparatus 3.

In the image forming apparatus constituted as described above, during image formation, the photosensitive drum 1 is rotated/driven by driving means, and the surface of the photosensitive drum 1 is uniformly charged by the primary charging unit 2. Moreover, an image exposure light L provided by a laser light is applied onto the charged photosensitive drum 1 from the exposing apparatus 6, an electrostatic latent image is formed in accordance with inputted image information, and the electrostatic latent image is developed and visualized as a toner image by the developing apparatus 3.

Moreover, the toner image formed on the photosensitive drum 1 is transferred to a transferring material P such as a sheet in a transferring portion N by the transfer charging unit 4, and the transferring material P with the toner image transferred thereto is conveyed into a fixing apparatus (not shown). After the transferred toner image is fixed to the surface of the transferring material P by the fixing apparatus, the material is discharged. After transferring, a residual transferring toner adhering to the surface of the photosensitive drum 1 is removed by the cleaning apparatus 5.

Moreover, in conventional image forming apparatuses, an upper guide member 20 and a lower guide member 21 for guiding upper and lower surfaces of the transferring material P, respectively, are disposed on an upstream side of the transferring portion N, so that the transferring material P is steadily and securely guided into the transferring portion N. Additionally, the upper and lower guide members 20, 21 are constituted of insulating members, and absorb moisture particularly under a high-humidity environment, and the like. A transferring current leaking to the upper and lower guide members 20, 21 from the transfer charging unit 4 via the transferring material P having a reduced resistance is prevented from causing transferring defects such as null transfer.

Additionally, in the image forming apparatus, tip ends of the upper and lower guide members 20, 21 on a transferring portion N side are disposed at a very short interval of about 1.3 mm from the surface of the photosensitive drum 1, so that the upper and lower guide members 20, 21 steadily and securely guide the transferring material P into the transferring portion N. Therefore, since the upper and lower guide members 20, 21 are positioned in the vicinity of the transfer charging unit 4, the members easily receive a charge from the transfer charging unit 4, and are easily charged with the same polarity as that of the transferring current, that is, with a polarity opposite to that of the toner.

Therefore, a toner floating in the image forming apparatus, particularly a toner on the surface of the photosensitive drum 1 positioned immediately before the transferring portion N, and the like are electrostatically sucked by and attached to the upper and lower guide members 20, 21 (particularly, a tip end 21*a* closest to the photosensitive drum 1 in the lower guide member 21 disposed in the vicinity of the photosensitive drum 1). The toner adheres to the transferring material P and soils the transferring material P. This causes a disadvantage in that image quality is deteriorated.

Particularly, in a reversal developing system of the developing apparatus 3 (system for forming the toner image on the surface of the photosensitive drum 1 which holds a potential of the same polarity as that of the toner), an adhering force of the toner to the surface of the photosensitive drum 1 is relatively weak. Therefore, the toner, and the like tend to be electrostatically sucked by and easily attached to the upper guide member 20.

Therefore, in order to prevent the toner, and the like adhering to the upper and lower guide members 20, 21 from adhering to the transferring material P, the upper and lower guide members 20, 21 are constituted, for example, of electric conductive members. Moreover, a bias voltage having a polarity opposite to that of the transferring current (the same polarity as that of the toner) is applied. This method has heretofore been proposed. However, in this constitution, leakage of the transferring current into the guide members 20, 21 from the transfer charging unit 4 tends to be induced. Therefore, in conveyance of the transferring material P whose moisture has been absorbed and whose resistance has been reduced, the transferring current runs short and null transfer becomes conspicuous.

Particularly, in a contact transferring system of transferring means represented by a transferring roller, because of transferring current shortage, and reduction of a transferring voltage, transferring defects such as a spotted null (poor) transfer portion attributed to partial resistance irregularity of the transferring roller tend to become conspicuous. As a countermeasure for preventing such transferring defect, the insulating members are disposed on inner guide surfaces of the upper and lower guide members 20, 21 for guiding the transferring material P. Thereby, while a certain degree of surface potential of the guide surface is held, the transferring current can be prevented from leaking.

However, when the insulating member is disposed, the potential of the surface of the insulating member is reduced with respect to the potential of a bias applied to an electric conductive portion of the guide, and the toner adheres to a lower guide. The toner adhering to the lower guide is recovered by the transferring material P in a position in contact with the conveyed transferring material P. However, since the lower guide entirely has a flat shape, the position in contact with the transferring material P is not fixed. The position where the toner is recovered is displaced. The transferring material P contacts a position where a certain amount of toner is accumulated without contacting the transferring material P. Then, the accumulated toner shifts to the transferring material P, and sometimes becomes conspicuous as dirt on the transferring material P.

SUMMARY OF THE INVENTION

An object of the present invention is to provide an image forming apparatus in which null transfer is prevented even with respect to a transferring material having absorbed moisture, a toner, and the like are prevented from being deposited on a guide member for guiding the transferring material into a transferring portion and the transferring material is prevented from being soiled, and a satisfactory image can be obtained over a long time.

To achieve the aforementioned object, according to the present invention, there is provided an image forming apparatus comprising:

an image bearing member for bearing a developer image;

image forming means for forming the developer image on the image bearing member;

transferring means for electrostatically transferring the developer image borne on the image bearing member to a transferring material in a transferring area; and guiding means for guiding the transferring material to the transferring area, wherein the guiding means includes an insulating member disposed on a transferring material guide surface of the guiding means and a conductive member disposed on a surface of the guiding means opposite to the transferring material guide surface, and a power source capable of applying a voltage having a predetermined polarity is electrically connected to the conductive member, and a projection is disposed on the surface of the insulating member.

DETAILED DESCRIPTION OF THE EMBODIMENTS

Embodiments of the present invention will be described hereinafter with reference to the drawings.

<First Embodiment>

Figure 1:
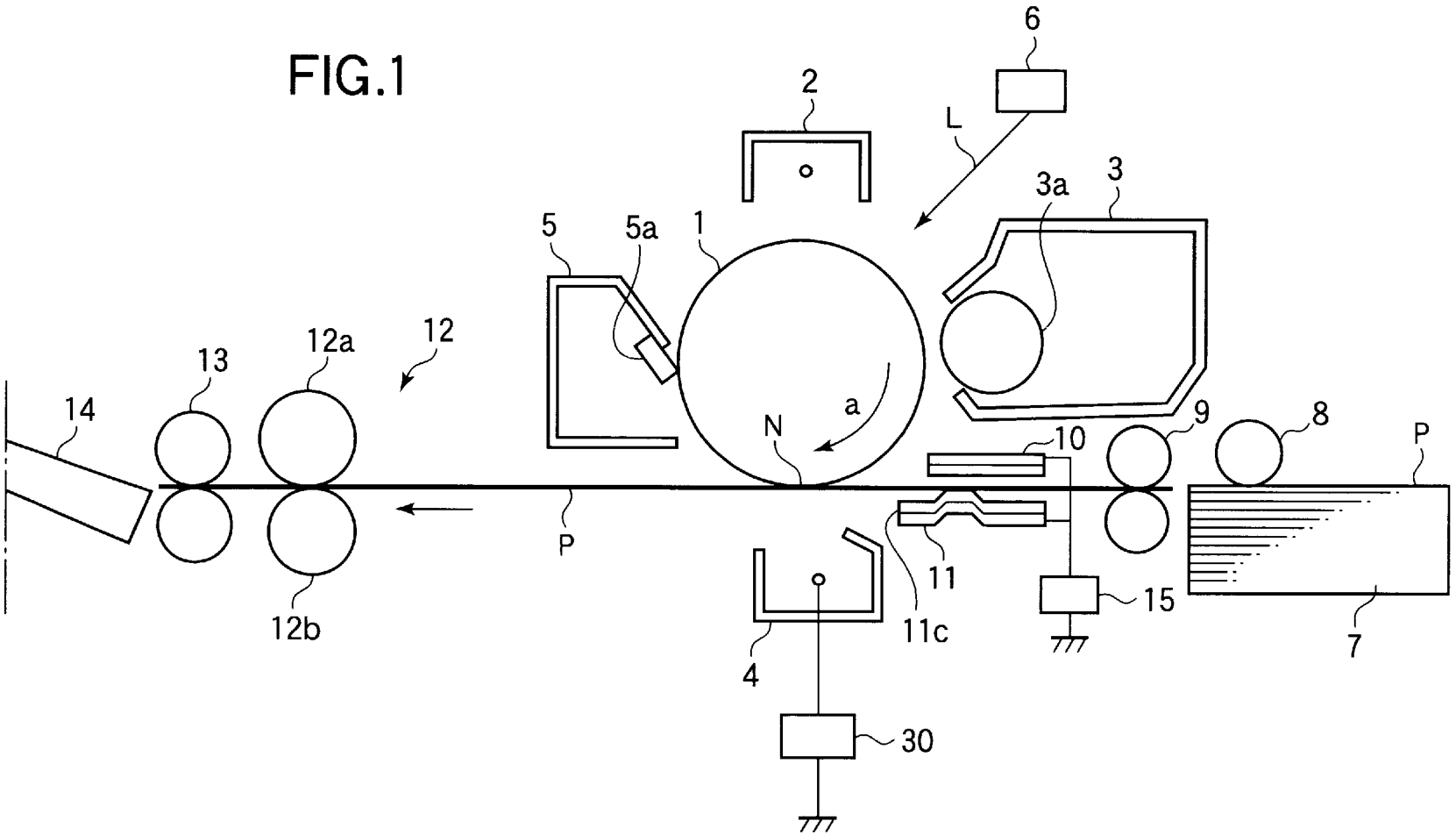
FIG. 1 is a schematic constitution diagram showing an image forming apparatus according to a first embodiment of the present invention.
Figure 7:
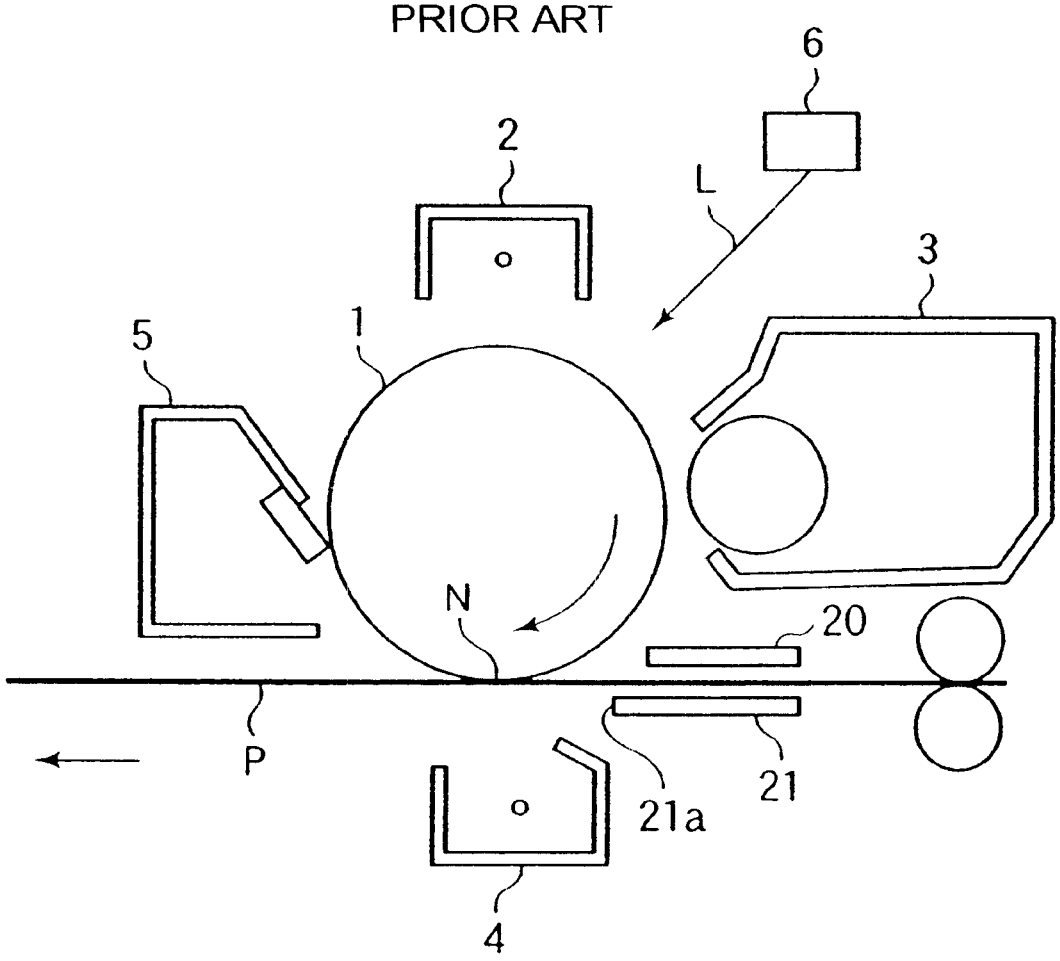
FIG.7 PRIOR ART
FIG. 7 is a schematic constitution diagram showing the image forming apparatus in a conventional example.

FIG. 1 is a schematic constitution diagram showing an image forming apparatus (image forming apparatus such as a laser printer of an electrophotographic system in the first embodiment) according to a first embodiment of the present invention. Additionally, the same members as those of a conventional image forming apparatus shown in FIG. 7 are denoted with the same reference numerals.

The image forming apparatus includes a photosensitive drum 1 as an image bearing member. A primary charging unit 2, developing apparatus 3, transfer charging unit 4 (corona charging system), and cleaning apparatus 5 are disposed around the photosensitive drum 1, and an exposing apparatus 6 is disposed above and between the primary charging unit 2 and the developing apparatus 3. Moreover, upper and lower guide members 10, 11 for guiding a transferring material P into a transferring portion N are disposed on an upstream side in a conveying direction of the transferring material P with respect to the transferring portion N formed between the photosensitive drum 1 and the transfer charging unit 4. A fixing apparatus 12 is disposed on a downstream side in the conveying direction of the transferring material P with respect to the transferring portion N.

The photosensitive drum 1 is a negatively charged organic photosensitive body in the first embodiment. A photosensitive layer (not shown) is disposed on an aluminum drum substrate (not shown). The drum is rotated/driven in a direction of an arrow a (clockwise direction) at a predetermined peripheral speed by driving of driving means (not shown), and uniformly charged with a negative polarity by the primary charging unit 2 in a rotation process.

The developing apparatus 3 includes a developing sleeve 3*a* rotatably disposed opposite to the photosensitive drum 1, and a developer (toner) carried by the surface of the developing sleeve 3*a* is attached to an electrostatic latent image on the surface of the photosensitive drum 1 and reversed/developed as a toner image.

The transfer charging unit 4 as transferring means transfers the toner image on the surface of the photosensitive drum 1 to the transferring material P in the transferring portion N in contact with the photosensitive drum 1 between the photosensitive drum 1 and the transfer charging unit 4 by a transferring bias applied from a transferring bias power source 30.

For the exposing apparatus 6 as exposing means, a laser light modulated in response to a time series digital image signal of image information inputted from a host computer (not shown) is outputted from a laser output portion (not shown). Then, the charged surface of the photosensitive drum 1 is exposed to an image exposure light L, and a potential on the photosensitive drum 1 charged by the primary charging unit 2 is reduced so that the electrostatic latent image is formed in accordance with the image information.

The fixing apparatus 12 includes a fixing roller 12*a* and a pressurizing roller 12*b*, holds/conveys the transferring material P in a fixing nip between the fixing roller 12*a* and the pressurizing roller 12*b*, and heats, pressurizes and thermally fixes the toner image transferred onto the surface of the transferring material P.

The upper and lower guide members 10, 11 steadily and securely guide the transferring material P into the transferring portion N (details of the upper and lower guide members 10, 11 as characteristics of the present invention will be described later).

An image forming operation by the image forming apparatus will next be described.

When the image information is inputted from the host computer (not shown), the photosensitive drum 1 is driven by the driving means (not shown) and rotated/driven in the direction of the arrow a (clockwise direction) at the predetermined peripheral speed (process speed), and the surface of the drum is uniformly charged at a predetermined potential by the primary charging unit 2. Subsequently, the image exposure light L by the laser light subjected to image modulation is applied onto the charged photosensitive drum 1 from the exposing apparatus 6, the potential of a portion exposed to the image exposure light L on the photosensitive drum 1 is lowered, and the electrostatic latent image is formed in accordance with an inputted image signal.

Subsequently, the developer (toner) charged in the same polarity as the charged polarity (negative polarity) of the photosensitive drum 1 is attached to the electrostatic latent image formed on the photosensitive drum 1 by the developing sleeve 3*a* of the developing apparatus 3 to which the developing bias of the same polarity as the charged polarity (negative polarity) of the photosensitive drum 1 is applied in a developing position. Then, the developer is reversed/developed (visualized) as the toner image.

Subsequently, when the toner image on the photosensitive drum 1 reaches the transferring portion N abutting on the photosensitive drum 1 between the photosensitive drum 1 and the transfer charging unit 4, the transferring material P such as the sheet in a cassette 7 is conveyed by a sheet feeding rollers 8, a pair of conveying roller 9, and the like at this timing. The material is further guided by the inner guide surfaces of the upper and lower guide members 10, 11, and conveyed into the transferring portion N. Moreover, the toner image on the photosensitive drum 1 is transferred to the transferring material P conveyed into the transferring portion N by the transfer charging unit 4 in which the transferring bias of the polarity (positive polarity) opposite to that of the toner is applied to conductive members 10*a* (FIG. 2) and 11*a* (FIG. 3) by the transferring bias power source 30.

Moreover, the transferring material P with the toner image transferred thereto is conveyed into the fixing apparatus 12. After the toner image is heated, pressurized and thermally fixed to the transferring material P in the fixing nip between the fixing roller 12*a* and the pressurizing roller 12*b*, the material is discharged to a sheet discharging tray 14 via a pair of sheet discharging rollers 13. A series of image forming operations is thereby ended.

Moreover, a residual transferring toner remaining on the surface of the photosensitive drum 1 with the toner image transferred thereto is removed and recovered by a cleaning blade 5*a* of the cleaning apparatus 5, and the apparatus is prepared for the next image forming operation.

Constitutions of the upper and lower guide members 10, 11 will next be described.

The upper and lower guide members 10, 11 steadily and securely guide the conveyed transferring material P into the transferring portion N, so that the transferring material P closely adheres to the surface of the photosensitive drum 1. For this, tip ends of the upper and lower guide members 10, 11 on a transferring portion N side are disposed in the vicinity of the surface of the photosensitive drum 1. For example, a distance between a tip end (portion closest to the photosensitive drum 1) 11*c* of the lower guide member 11 and the photosensitive drum 1 is set to 1.0 mm.

Figure 2:
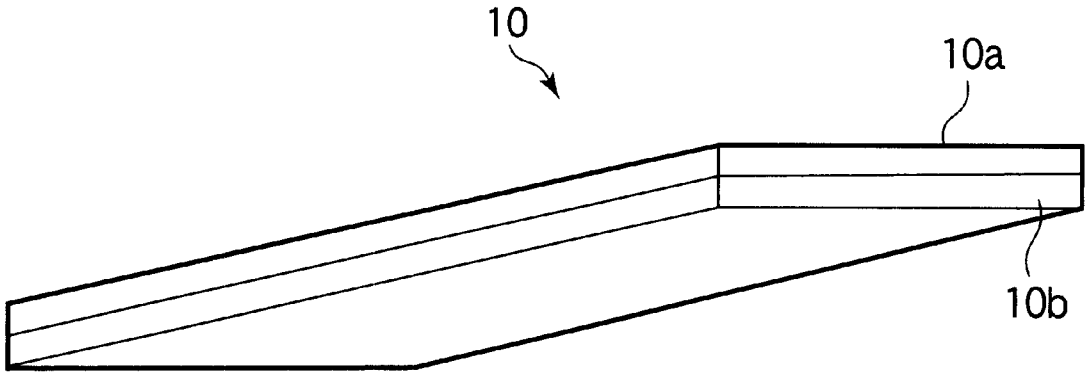
FIG. 2 is a perspective view showing an upper guide member of the image forming apparatus according to the first embodiment of the present invention.
Figure 3:
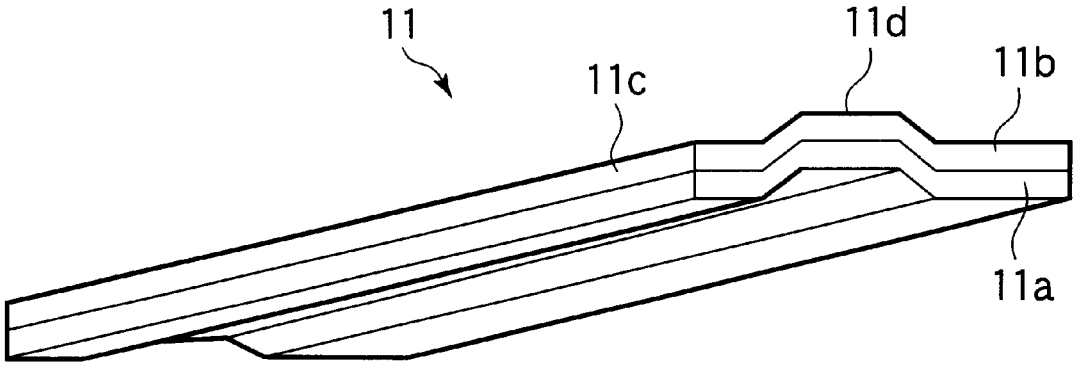
FIG. 3 is a perspective view showing a lower guide member of the image forming apparatus according to the first embodiment of the present invention.

As shown in FIGS. 2 and 3, the upper and lower guide members 10, 11 are constituted by bonding insulating members (e.g., about 100 $\mu$m thick polytetrafluofoethylene (PTFE) sheets in the first embodiment) 10*b* and 11*b* to electrically-conductive members (iron sheets in the first embodiment) 10*a* and 11*a* disposed opposite to a transferring material passing surface (surface disposed opposite to the passed transferring material) in a guide so that the insulating members face a transferring material passing surface side (inside the conductive members 10*a*, 11*a*). The conductive members 10*a*, 11*a* of the upper and lower guide members 10, 11 are connected to a power source 15, and a bias voltage of the polarity opposite to the polarity of the transferring bias voltage applied to the transfer charging unit 4 during conveying of the transferring material P (the same polarity as that of the toner forming the toner image) is applied.

Additionally, in the upper and lower guide members 10, 11, the toner easily adheres to the lower guide member 11 for guiding the surface of the transferring material P on a transfer charging unit 4 side (the surface disposed opposite to the surface to which the toner image is transferred). To solve the problem, in the first embodiment, as shown in FIG. 3, a projection shape along a longitudinal direction is molded in a predetermined position of the conductive member 11*a* of the lower guide member 11 in a transferring material conveying direction (e.g., a position at about 2.5 mm from the tip end 11*c* on the transferring portion N side in the first embodiment), and the surface of the projection shape forms a projection surface 11*d*. For the projection surface 11*d* in the insulating member 11*b* positioned on a transferring material guide surface (transferring material passing surface) side, a height from a surface having no molded projection is set, for example, to 0.5 mm in the first embodiment.

For example, a stamping processing for the sheet metal can be used in molding the projection shape of the conductive member 11*a*.

As described above, in the first embodiment, the projection surface 11*d* formed on the insulating member 11*b* of the lower guide member 11 is in a position higher than each flat portion (the surface having no molded projection) positioned on the upstream/downstream side in the transferring material conveying direction. Therefore, the projection surface 11*d* guides the transferring material P under contact by a back surface of the conveyed transferring material P.

Therefore, the toner scattered from the toner image on the photosensitive drum proceeding to the transferring portion N by the rotation of the photosensitive drum 1 adheres to various positions of the lower guide member 11. Even in this case, the toner adhering to the projection surface 11*d* frequently contacting the transferring material P contacts the back surface (the surface on a lower guide member 11 side) of the transferring material P passed between the upper and lower guide members 10, 11 and conveyed to the transferring portion N, and is thereby constantly recovered. Therefore, the toner can be prevented from being deposited on the projection surface 11*d* of the lower guide member 11. Moreover, since the toner is constantly recovered, an amount of toner recovered by the transferring material P is slight, and the toner is not as conspicuous as dirt on the transferring material. Additionally, the toner adhering to portions other than the projection surface 11*d* does not raise problems such as dirt, because the transferring material P does not contact the portions other than the projection surface 11*d*.

Moreover, in a constitution in which the tip end 11*c* of the lower guide member 11 is disposed in the vicinity of the photosensitive drum 1, the conveyed transferring material P is guided by the projection surface 11*d* and tip end 11*c*. In this case, the transferring material P contacts only these two positions, the toner adhering to the guide is constantly recovered from these two frequently contacted positions, and the toner is prevented from being deposited on the two positions.

Additionally, the present invention is effective particularly in a case in which the developing apparatus 3 of the reversal developing system is used as in the first embodiment, because a relatively large amount of toner is scattered.

Moreover, the transferring material passing surface side of the upper and lower guide members 10, 11 is coated with the insulating members 10*b*, 11*b*. Therefore, even with the transferring material P which has absorbed moisture and whose resistance has been lowered, the transferring current is prevented from leaking through the upper and lower guide members 10, 11, and null transfer can be prevented from occurring.

Furthermore, the bias voltage of the polarity opposite to that of the transferring bias voltage is applied to the conductive members 10*a*, 11*a* of the upper and lower guide members 10, 11 from the power source 15, and this more effectively prevents the toner from adhering to the upper and lower guide members 10, 11.

Additionally, in the first embodiment, the height of the projection surface 11*d* of the lower guide member 11 is set to 0.5 mm, but the height of the projection surface 11*d* is not limited to this, and an arbitrary height can be set. Moreover, the position of the projection surface 11*d* can also be set to an arbitrary position. Furthermore, one projection surface 11*d* is disposed in the first embodiment, but a plurality of projection surfaces 11*d* may also be disposed.

Moreover, in the first embodiment, materials of the insulating members 10*b*, 11*b* of the upper and lower guide members 10, 11 are PTFE, but these materials are not so limited. Additionally, any other material such as ABS resin, can preferably be used as long as an insulating property is satisfactory. Moreover, a coating processing may also be performed.

<Second Embodiment>

Figure 4:
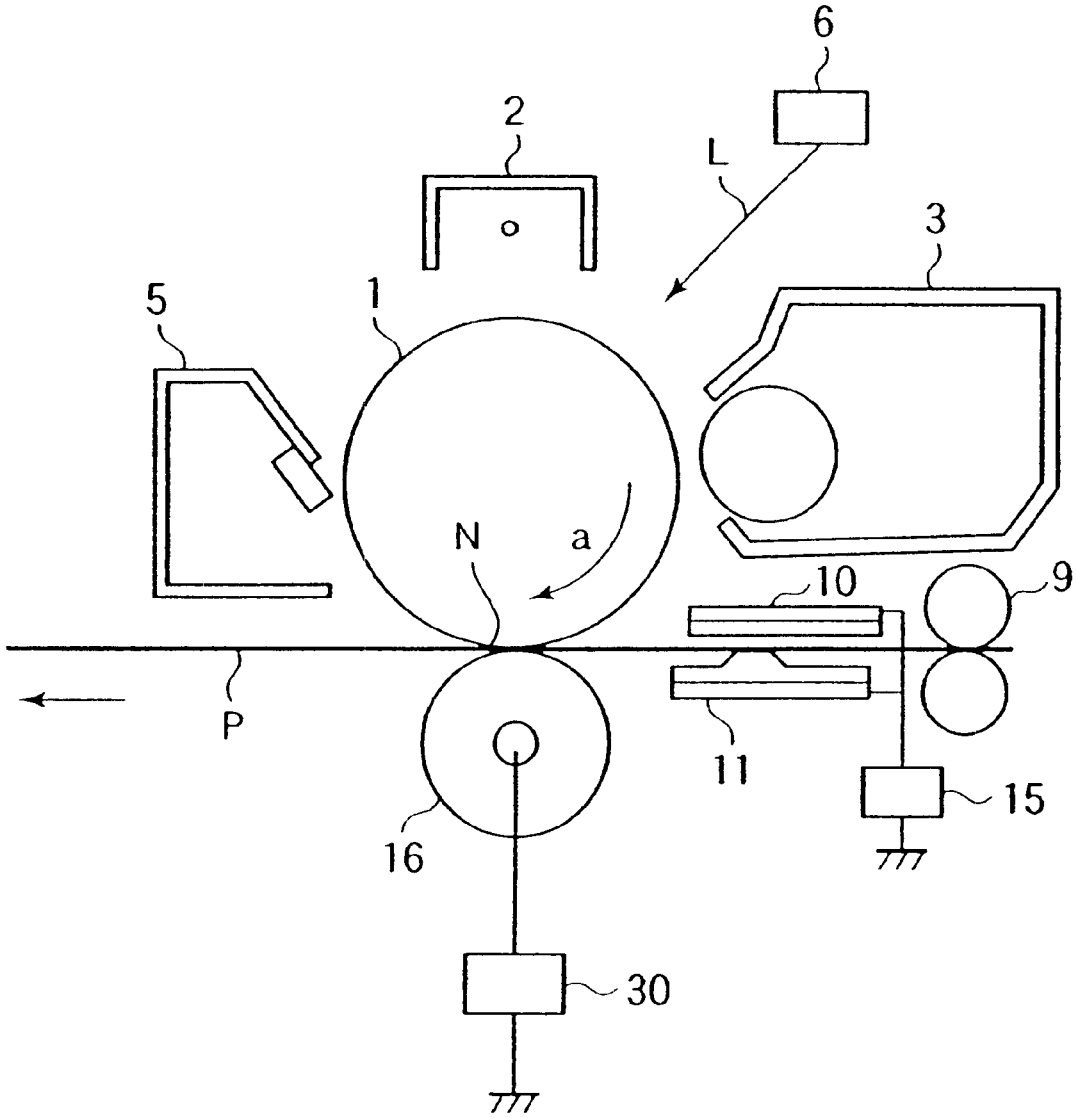
FIG. 4 is a schematic constitution diagram showing the image forming apparatus according to a second embodiment of the present invention.
Figure 5:
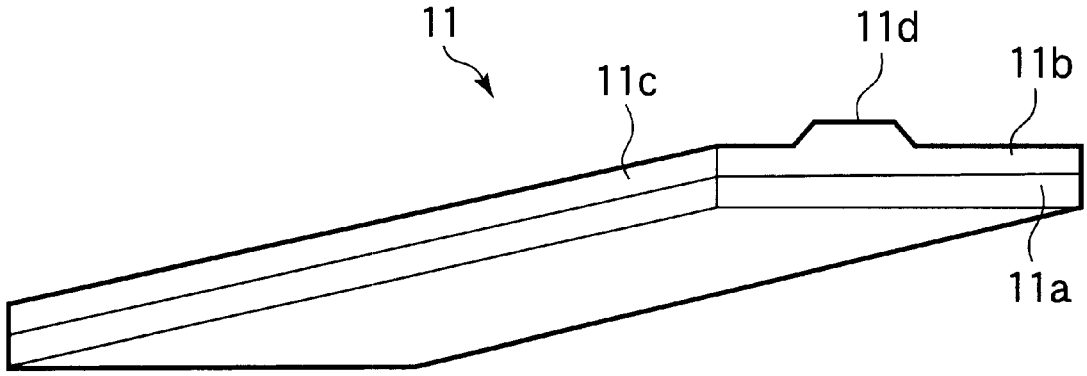
FIG. 5 is a perspective view showing the lower guide member of the image forming apparatus according to the second embodiment of the present invention.

FIG. 4 is a schematic constitution diagram showing the image forming apparatus according to a second embodiment of the present invention, and FIG. 5 shows a lower guide member 11 in the second embodiment. Additionally, a member having the same function as that of the image forming apparatus of the first embodiment is denoted with the same reference numeral, and redundant description is omitted.

The lower guide member 11 of the second embodiment is constituted by bonding the insulating member 11*b* of ABS resin having a thickness of about 200 μm to an inner side (transferring material passing surface side) of a conductive member 11*a* formed of a flat SUS sheet having a thickness of 1.0 mm. A projection surface 11*d* having a substantially flat surface and having a height of about 300 μm along the longitudinal direction is formed in a predetermined position of the insulating member 11*b* (e.g., a position of about 2.5 mm from a tip end 11*c* on the transferring portion side in a direction opposite to the transferring material conveying direction in the second embodiment). A power source 15 is connected to a conductive members 10*a*, 11*a* of the upper and lower guide members 10, 11, and the bias voltage of the polarity opposite to that of the transferring bias voltage applied to the transfer charging unit 4 during conveying of the transferring material P (the same polarity as that of the toner forming the toner image) is applied.

Moreover, in the second embodiment, a transferring roller 16 of a contact transferring system is used as transferring means. Other constitutions and image forming operations are similar to those of the first embodiment. Only the lower guide member 11 will be described in the second embodiment.

The lower guide member 11 of the second embodiment is constituted by bonding the insulating member 11*b* of ABS resin with the projection surface 11*d* formed thereon to the conductive member 11*a* of SUS sheet as described above. Therefore, the projection surface 11*d* can be formed without performing the stamping processing of the sheet of the first embodiment.

The projection surface 11*d* of the insulating member 11*b* is thicker than another surface portion of the insulating member 11*b* by about 300 μm. During conveying of the transferring material P, for the potential of the surface of the insulating member 11*b* of the lower guide member 11 by the bias voltage applied to the conductive members 10*a*, 11*a* of the upper and lower guide members 10, 11, the potential of the projection surface 11*d* is slightly low (the potential which rather easily attracts the toner).

Therefore, in the second embodiment, an effect that the toner is electrostatically attracted by the projection surface 11*d* is obtained. Even when the toner scattered from the toner image proceeding to the transferring portion N by the rotation of the photosensitive drum 1 adheres to various positions of the lower guide member 11, the toner adhering to the projection surface 11*d* frequently contacting the transferring material P contacts the back surface (the surface on the lower guide member 11 side) of the transferring material P passed between the upper and lower guide members 10, 11 and conveyed to the transferring portion N, and is thereby constantly recovered. Therefore, the toner can be prevented from being deposited on the projection surface 11*d* of the lower guide member 11. Moreover, since the toner is constantly recovered, the amount of toner recovered by the transferring material P is slight, and the toner is not conspicuous as dirt on the transferring material P. Additionally, the toner adhering to the portions other than the projection surface 11*d* does not raise problems such as dirt, because the transferring material P does not contact the portions other than the projection surface 11*d*.

Furthermore, in the constitution in which the tip end 11*c* of the lower guide member 11 is disposed in the vicinity of the photosensitive drum 1, the conveyed transferring material P is guided by the projection surface 11*d* and tip end 11*c*. In this case, the transferring material P contacts only these two positions, the toner adhering to the guide is constantly recovered from these two frequently contacted positions, and the toner is prevented from being deposited on the two positions.

Additionally, the present invention is effective particularly in the case in which the developing apparatus 3 of the reversal developing system is used as in the second embodiment, because the relatively large amount of toner is scattered.

Moreover, also in the second embodiment, the transferring material passing surfaces of the upper and lower guide members 10, 11 are coated with the insulating members 10*b*, 11*b*. Therefore, even with the transferring material P which has absorbed moisture and whose resistance has been lowered, the transferring current is prevented from leaking through the upper and lower guide members 10, 11, and the null transfer can be prevented from occurring. Particularly, a spotted null transfer can effectively be prevented in the contact transferring system in which the transferring roller 16 is used and a total transferring current value is small.

Additionally, the guide shape described in the second embodiment can also be used in the image forming apparatus in which the transferring apparatus of the corona charging system described in the first embodiment is used.

<Third Embodiment>

Figure 6:
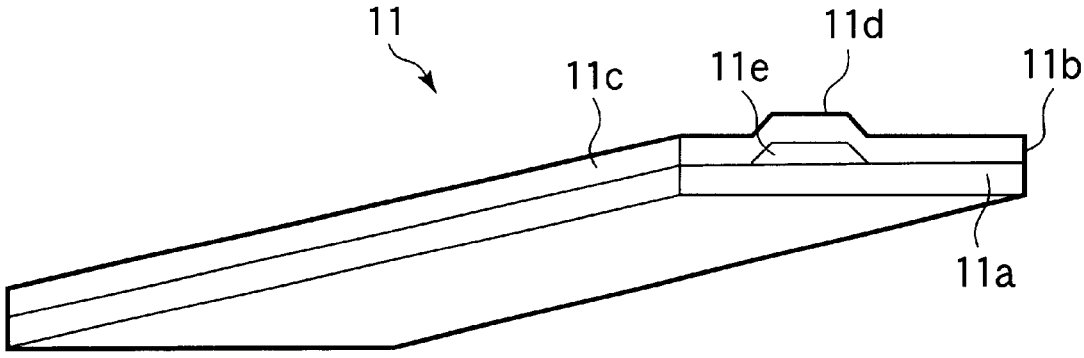
FIG. 6 is a perspective view showing the lower guide member of the image forming apparatus according to a third embodiment of the present invention.

In the lower guide member 11 of a third embodiment, as shown in FIG. 6, an insulating flat member 11*e* having a predetermined size along the longitudinal direction is fixed as a height adjustment member in a predetermined position (position of about 2.5 mm from the tip end 11*c* on the transferring portion N side in the third embodiment) of a bonded surface of the conductive member 11*a* with the insulating member 11*b*. The height adjustment member is coated with the thin-sheet insulating member 11*b* and the projection surface 11*d* having the flat surface is formed.

Other constitutions and image forming operations in the third embodiment are similar to those of the first embodiment. Only the lower guide member 11 will be described in the third embodiment.

For the lower guide member 11 of the third embodiment, an about 100 μm thick polytetrafluofoethylene (PTFE) sheet is used as the insulating member 11*b* and insulating flat member 11*e*, and bonded to the conductive member 11*a* by an insulating double-surface tape.

Even when the lower guide member 11 of the third embodiment is used in this manner, similarly as the first and second embodiments, the toner is prevented from being deposited on the lower guide member 11 and the transferring material P is prevented from being soiled, or the null transfer can be prevented even with the transferring material P having absorbed moisture.

Moreover, since the sheet-shaped insulating member 11*b* is bonded onto the insulating flat member 11*e* in the third embodiment, the projection surface 11*d* can easily and simply be formed on the insulating member 11*b*, and cost can be reduced.

Additionally, the guide shape described in the third embodiment can also be used in the image forming apparatus in which either one of the transferring apparatus of the corona charging system described in the first embodiment and the transferring apparatus of the transferring roller system described in the second embodiment is used.

Moreover, the guide shape, various numeric values, materials, and the like are only illustrated in the second and third embodiments, and are not limited as long as the effect of the present invention is obtained.

As described above, according to the present invention, the null transfer is prevented even with respect to the transferring material having absorbed moisture. Additionally, the toner, and the like are prevented from being deposited on the guide member for guiding the transferring material to the transferring portion, and the dirt of the transferring material is prevented. Therefore, a satisfactory image can be obtained over a long term.

What is claimed is:

1. An image forming apparatus comprising:

an image bearing member for bearing a developer image;

image forming means for forming the developer image on said image bearing member;

transferring means for electrostatically transferring the developer image borne on said image bearing member to a transferring material in a transferring area; and guiding means for guiding said transferring material to the transferring area, wherein said guiding means includes an insulating member disposed on a transferring material guide surface of said guiding means and a conductive member disposed on a surface of said guiding means opposite to said transferring material guide surface, wherein a power source capable of applying a voltage having a predetermined polarity is electrically connected to said conductive member, and wherein a projection is provided on a surface of said insulating member.

2. An image forming apparatus according to claim 1, wherein a vertex of said projection is a substantially flat surface.

3. An image forming apparatus according to claim 1, wherein said projection is disposed at approximately a right angle with respect to a transferring material conveying direction.

4. An image forming apparatus according to claim 3, wherein said projection is disposed at a midway position of said guiding means in the transferring material conveying direction.

5. An image forming apparatus according to claim 1, wherein said projection is formed by molding a part of said conductive member into a projecting shape.

6. An image forming apparatus according to claim 1, wherein said projection is formed by thickening a portion of said insulating member.

7. An image forming apparatus according to claim 1, wherein said projection is provided by disposing a height adjustment member between said insulating member and said conductive member.

8. An image forming apparatus according to claim 7, wherein said height adjustment member is made of an insulating material.

9. An image forming apparatus according to claim 1, wherein the predetermined polarity is a same polarity as a normal charging polarity of a developer.

10. An image forming apparatus according to claim 1, wherein said image forming means includes charging means for charging said image bearing member, exposing means for exposing a portion corresponding to an image, and developing means for developing an exposed portion with a developer having a same polarity as a charging polarity of said charging means.

11. An image forming apparatus according to claim 1, wherein said transferring means includes a contact transferring member, which contacts said image bearing member.

12. An image forming apparatus comprising:

an image bearing member for bearing a developer image;

image forming means for forming the developer image on said image bearing member;

transferring means for electrostatically transferring the developer image borne on said image bearing member to a transferring material in a transferring area; and guiding means for guiding said transferring material to the transferring area, wherein said guiding means includes a first guide member for guiding an image transferring surface of the transferring material, and a second guide member for guiding a surface of the transferring material opposite to the image transferring surface of the transferring material, wherein each of said first guide member and said second guide member includes an insulating member disposed on a transferring material guide surface of said guiding means, and a conductive member disposed on a surface of said guiding means opposite to said transferring material guide surface, wherein a power source capable of applying a voltage having a predetermined polarity is electrically connected to both of said conductive member disposed on said first guide member and said conductive member disposed on said second guide member, and wherein a projection is provided on a surface of said insulating member of said second guide member.

13. An image forming apparatus according to claim 12, wherein a vertex of said projection is a substantially flat surface.

14. An image forming apparatus according to claim 12, wherein said projection is disposed at approximately a right angle with respect to a transferring material conveying direction.

15. An image forming apparatus according to claim 14, wherein said projection is disposed at a midway position of said second guide member in the transferring material conveying direction.

16. An image forming apparatus according to claim 12, wherein said projection is formed by molding a part of the conductive member of said second guide member into a projecting shape.

17. An image forming apparatus according to claim 12, wherein said projection is formed by thickening a portion of the insulating member of said second guide member.

18. An image forming apparatus according to claim 12, wherein said projection is provided by disposing a height adjustment member between the insulating member of said second guide member and the conductive member of said second guide member.

19. An image forming apparatus according to claim 18, wherein said height adjustment member is made of an insulating material.

20. An image forming apparatus according to claim 12, wherein the predetermined polarity is a same polarity as a normal charging polarity of a developer.

21. An image forming apparatus according to claim 12, wherein said image forming means includes charging means for charging said image bearing member, exposing means for exposing a portion corresponding to an image, and developing means for developing the exposed portion with a developer image having a same polarity as a charging polarity of said charging means.

22. An image forming apparatus according to claim 12, wherein said transferring means includes a contact transferring member, which contacts said image bearing member.

23. An image forming apparatus comprising:

an image bearing member for bearing a developer image;

image forming means for forming the developer image on said image bearing member;

transferring means for electrostatically transferring the developer image borne on said image bearing member to a transferring material in a transferring area; and guiding means for guiding said transferring material to the transferring area, wherein said guiding means includes an insulating member disposed on a transferring material guide surface of said guiding means and a conductive member disposed adjacent to said insulating member, wherein a power source capable of applying a voltage having a predetermined polarity is electrically connected to said conductive member, and wherein a projection is providing on a surface of said insulating member.

24. An image forming apparatus comprising:

an image bearing member for bearing a developer image;

image forming means for forming the developer image on said image bearing member;

transferring means for electrostatically transferring the developer image borne on said image bearing to a transferring material in a transferring area; and guiding means for guiding said transferring material to the transferring area, wherein said guiding means includes a first guide member for guiding an image transferring surface of the transferring material, and a second guide member for guiding a surface of the transferring material opposite to the image transferring surface of the transferring material, wherein each of said first guide member and said second guide member including an insulating member disposed on a transferring material guide surface of said guiding means, and a conductive member disposed adjacent to said insulating member, wherein a power source capable of applying a voltage having a predetermined polarity is electrically connected to both of said conductive member disposed on said first guide member and said conductive member disposed on said second guide member, and wherein a projection is provided on a surface of said insulating member of said second guide member.

* * * * *

UNITED STATES PATENT AND TRADEMARK OFFICE

CERTIFICATE OF CORRECTION

PATENT NO. : 6,701,119 B2
DATED : March 2, 2004
INVENTOR(S) : Satoshi Tomiki et al.

It is certified that error appears in the above-identified patent and that said Letters Patent is hereby corrected as shown below:

Column 1,
Line 19, “to” should read -- to as --.

Column 3,
Line 21, “means” should read -- means, --.

Column 5,
Line 16, “rollers” should read -- roller --; and “roller” should read -- rollers --; and
Line 53, “polytetrafluofoethylene” should read -- polytetrafluoroethylene --.

Column 7,
Line 46, “a” should be deleted.

Column 9,
Line 6, “polytetrafluofoethylene” should read -- polytetrafluoroethylene --;
Line 11, “as” should read -- as in --; and
Line 26, “and” should read -- or --.

Column 12,
Line 16, “bearing” should read -- bearing member --; and
Line 27, “including” should read -- includes --.

Signed and Sealed this

Thirteenth Day of July, 2004

JON W. DUDAS
*Acting Director of the United States Patent and Trademark Office*